US006907939B1

(12) United States Patent
Cuyler

(10) Patent No.: US 6,907,939 B1
(45) Date of Patent: Jun. 21, 2005

(54) FIRE HOSE STORAGE AND DEPLOYMENT SYSTEM AND METHOD

(76) Inventor: John Cuyler, 3630 Ranch Rd. 8-6, Columbia, SC (US) 29206

( * ) Notice: Subject to any disclaimer, the term of this patent is extended or adjusted under 35 U.S.C. 154(b) by 0 days.

(21) Appl. No.: 10/830,532

(22) Filed: Apr. 23, 2004

(51) Int. Cl.[7] ..... A62C 2/00; B65H 75/00; B05B 15/10

(52) U.S. Cl. ..... 169/46; 169/13; 169/16; 239/198; 239/208; 137/355.16; 137/355.17

(58) Field of Search ..... 169/46, 13, 16, 169/18, 25, 52, 70; 239/198, 208, 195, 197; 137/355.16, 355.17, 355.26

(56) References Cited

U.S. PATENT DOCUMENTS 2,053,654 A * 9/1936 Davis ..... 239/196
3,878,896 A * 4/1975 White et al. ..... 169/9
4,006,948 A 2/1977 Kessinger ..... 312/242
4,062,493 A * 12/1977 Suggs ..... 239/197
4,429,931 A 2/1984 Brooks ..... 312/228
4,519,657 A 5/1985 Jensen ..... 339/15

* cited by examiner

*Primary Examiner*—David A. Scherbel
*Assistant Examiner*—Darren Gorman
(74) *Attorney, Agent, or Firm*—Goldstein Law Offices, P.C.

(57) ABSTRACT

A system for storing and deploying fire hoses to combat a fire on a selected floor of a high-rise building. The system includes an underground storage area directly beneath the building, a plurality of reel assemblies located inside the storage area, an underground pump, an integrated piping network, a plurality of mechanical tracks and a station located on the roof that has a pair of roof standpipes extending therefrom. Each reel assembly has a reel, a fire hose and an underground standpipe. Each track extends vertically along side walls of the building. In use, an operator uses an electronic control panel in communication with the reels and the rollers to specify the floor of the fire. The hoses unravel from their reels and are propelled up the tracks by rotating rollers. The pump turns on and transports water from an independent source, through the piping network and to the hoses.

5 Claims, 3 Drawing Sheets

FIRE HOSE STORAGE AND DEPLOYMENT SYSTEM AND METHOD

BACKGROUND OF THE INVENTION

1. Field of the Invention

The invention generally relates to fire hoses, and in particular it relates to a system and method for quickly deploying internally stored fire hoses to selected floors of a high-rise commercial or residential building.

2. Description of the Related Art

People around the world watched in shock and horror as the tragic events of Sep. 11, 2001 in America unfolded before their eyes. As the World Trade Center towers collapsed into massive piles of rubble and human suffering, the citizens of an entire nation were turned numb by the overwhelming depth and range of their emotions. Any American old enough to understand the significance of those murderous terrorist attacks felt, among other emotions, disbelief, anger, fear, hate and pity. While unsuspecting thousands were brutally and senselessly killed that fateful day, one particular group of individuals suffered grave losses by choice. Hundreds of firefighters rushed headlong into the blazing towers, fully aware of the possible consequences of their bravery, and paid the ultimate price. This bravery sharpened the public's recognition of, and appreciation for, the heroic and selfless work performed by firefighters every day. The attacks taught us many other lessons as well, including the reality that occupants of high-rise buildings are especially vulnerable to fire-related disasters, whether they result from terrorism or other causes. Well-equipped firefighters are the best defense against the ravages of fire-related crises.

However, firefighters currently face a particularly acute difficulty when responding to incidents in high-rise buildings. Conventional ladder trucks cannot come close to delivering hoses and water to the upper stories of extremely tall buildings. Consequently, firefighters have no choice to pull fire hoses from their trucks or inside the building up and down staircases and around corners. This task is especially challenging since the amount of time that is needed to effectively combat fires often determines the extent of the subsequent human toll and property damage. Hence, there is a pressing need for a system that quickly deploys several water-filled fire hoses to selected floors of a high-rise building upon activation and stores the hoses under the building upon deactivation.

U.S. Pat. No. 4,006,948 to Kessinger ("Kessinger") teaches a fire hose cabinet that can be mounted on or in a wall with a fire hose wound on a spool therein. However, the fire hose cabinet of Kessinger would not expedite the task of fighting a fire on an upper floor of a high-rise building in any way.

U.S. Pat. No. 4,429,931 to Brooks ("Brooks") discloses a container adapted to be secured to a wall of a bathroom vanity that has a fire hose stored therein. However, the container of Brooks is primarily designed for cosmetic purposes and of minimal utility to firefighters when responding to an emergency.

U.S. Pat. No. 4,519,657 to Jensen ("Jensen") teaches a service unit comprising a hollow body within which power distribution means, power metering means, lighting means, water equipment and telephone equipment can be mounted. However, the service unit of Jensen is impractical since its electrical components could well be severely damaged when a fire hose is in use.

While these devices may be suitable for the particular purposes employed, or for general use, they would not be as suitable for the purposes of the present invention as disclosed hereafter.

SUMMARY OF THE INVENTION

It is an object of the invention to provide a system that conveniently stores deflated fire hoses in a building for future use. Accordingly, the system provides reel assemblies with reels around which deflated fire hoses are compactly wrapped. The reel assemblies are located in an underground storage area directly beneath the building.

It is another object of the invention to provide a system that allows water from outside of the building to travel through the hoses in order to combat a fire. Accordingly, the system has an integrated piping network that connects the hoses to an underground pump which increases flow and pressure from an independent source of water.

It is a further object of the invention to provide a system that can be used by firefighters to effectively quell a fire anywhere in a high-rise commercial or residential building. Accordingly, the system includes mechanical tracks that vertically extend along the side walls of the building from the roof to the underground storage area through which the hoses are propelled by rotating rollers.

It is a further object of the invention to provide a system that can be activated and deactivated by an authorized operator inside the building. Accordingly, an electronic control panel that the operator can use to selectively deploy and retract the hoses is present in the lobby of the building.

It is a further object of the invention to provide a system that can be used by firefighters to combat a fire in the building when the sprinkler system is disabled. Accordingly, the system includes standpipes on the roof of the building that are connected to the piping network. Firefighters can land on the roof with a helicopter and attach their hoses to the standpipes there.

The invention is a system for storing and deploying fire hoses to combat a fire on a selected floor of a high-rise building. The system includes an underground storage area directly beneath the building, a plurality of reel assemblies located inside the storage area, an underground pump, an integrated piping network, a plurality of mechanical tracks and a station located on the roof that has a pair of roof standpipes extending therefrom. Each reel assembly has a reel, a fire hose and an underground standpipe. Each track extends vertically along side walls of the building. In use, an operator uses an electronic control panel in communication with the reels and the rollers to specify the floor of the fire. The hoses unravel from their reels and are propelled up the tracks by rotating rollers. The pump turns on and transports water from an independent source, through the piping network and to the hoses.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
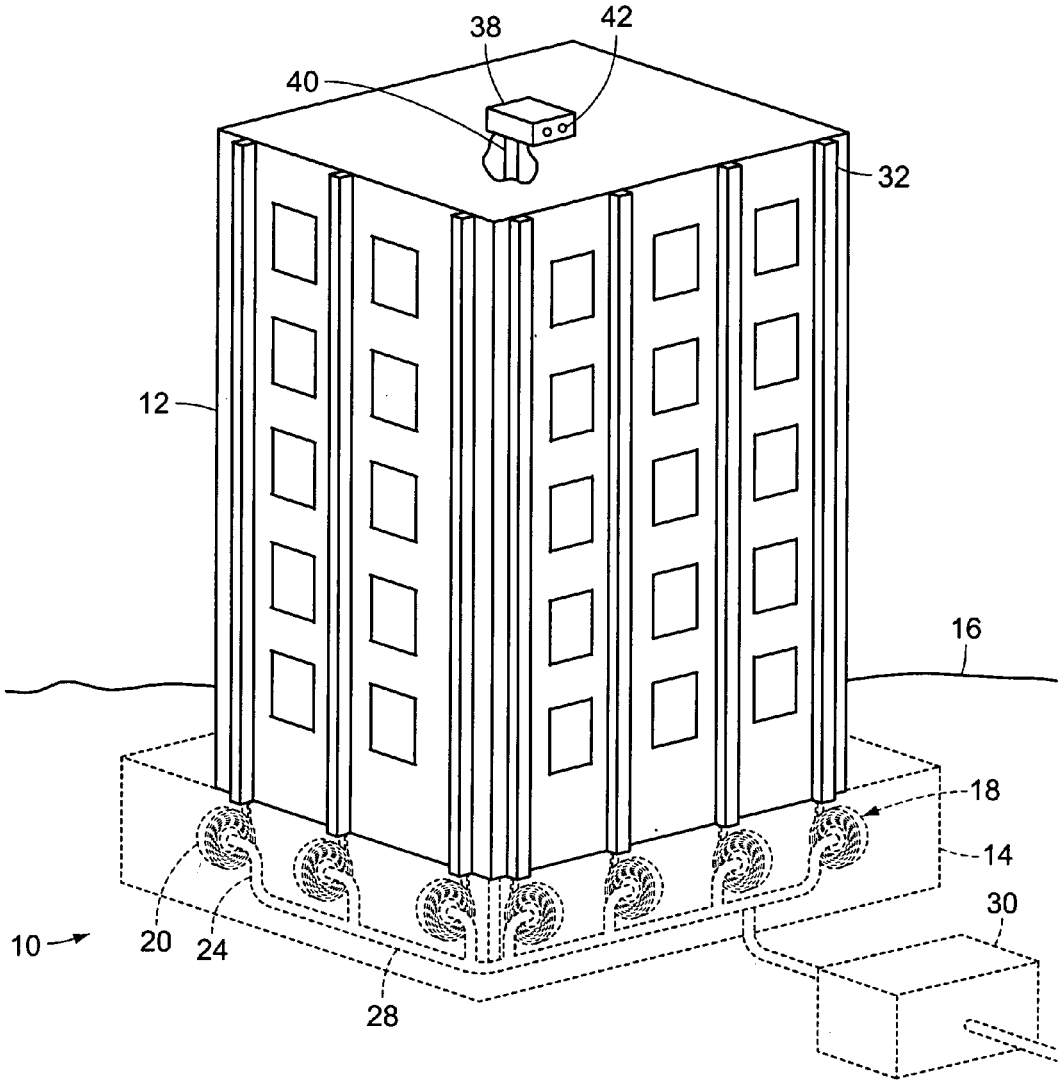
FIG. 1 is a diagrammatic perspective view with parts broken away of a high-rise building equipped with a fire hose storage and deployment system according to the present invention.

FIG. 1 depicts a high-rise commercial or residential building 12 equipped with a fire hose storage and deployment system 10 according to the present invention. The building 12 is shown as having five rectangular floors for illustrative purposes only; the system 10 can be employed with buildings of all sizes and configurations. A storage area 14 is present below ground level 16 directly beneath the building 12. The storage area 14 can be larger than any floor of the building 12 if sufficient excavation space is available in the immediate vicinity. A plurality of reel assemblies 18 is present inside the storage area 14.

Figure 2:
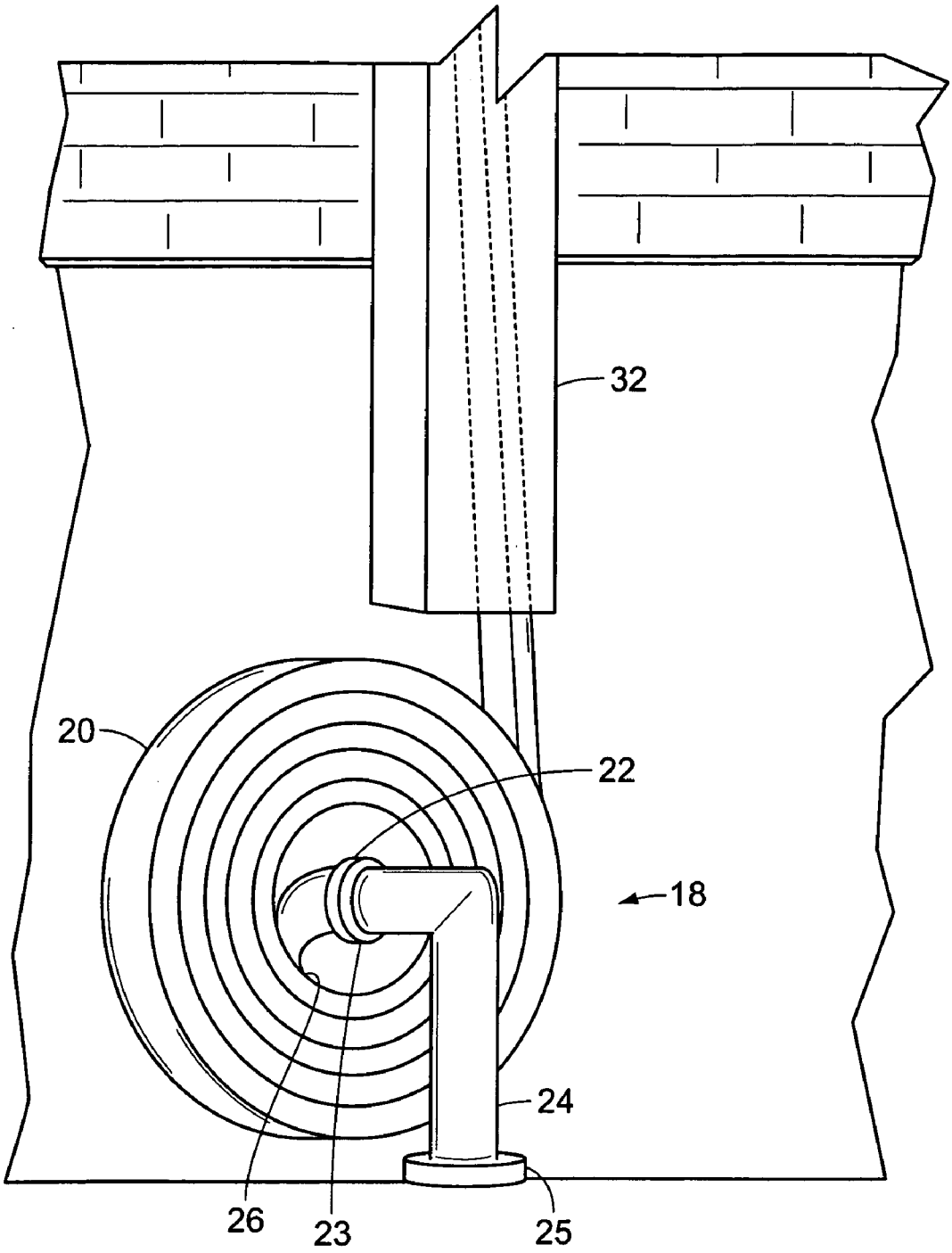
FIG. 2 is an exploded elevational view of a fire hose extending vertically from a reel assembly through a track according to the present invention. The portion of the hose that is inside the track is shown with hidden lines.

As FIG. 2 shows in detail, each reel assembly 18 consists of a circular reel 26, a fire hose 20 and an elbow-shaped underground standpipe 24 that has an inlet 25 and an outlet 23. The reel 26 has outer frame that is anchored to the underground standpipe 24 and a concentric inner core that rotates about its central axis. The hose 20 compactly wraps around the reel 26 and has a rear end 22 that mechanically fastens to the outlet 23 of the underground standpipe 24. Preferably, every reel assembly 18 is built to the same specifications and is consequently capable of handling about the same water load. The inlet 25 of every underground standpipe 24 attaches to an integrated piping network 28 that connects all of the hoses 20 to an underground pump 30. The engineering design of the piping network 28 can be as elaborate as necessary to accommodate the locations and capacities of the reel assemblies 18 and the pump 30. A plurality of mechanical tracks 32 vertically extend along the side walls of the building 12 from the roof to the storage area 14. The number and configuration of the tracks 32 depend upon the size and shape of the building 12 and can vary widely, although at least one track 32 should be present on each side wall. Each of the reel assemblies 18 is located below the lower end of a track 32. Every track 32 has a cylindrical shape with a rectangular cross-sectional area, a closed upper end and an open lower end. Preferably, the tracks 32 are constructed from a durable and non-corrosive metallic alloy or polymer.

Figure 3:
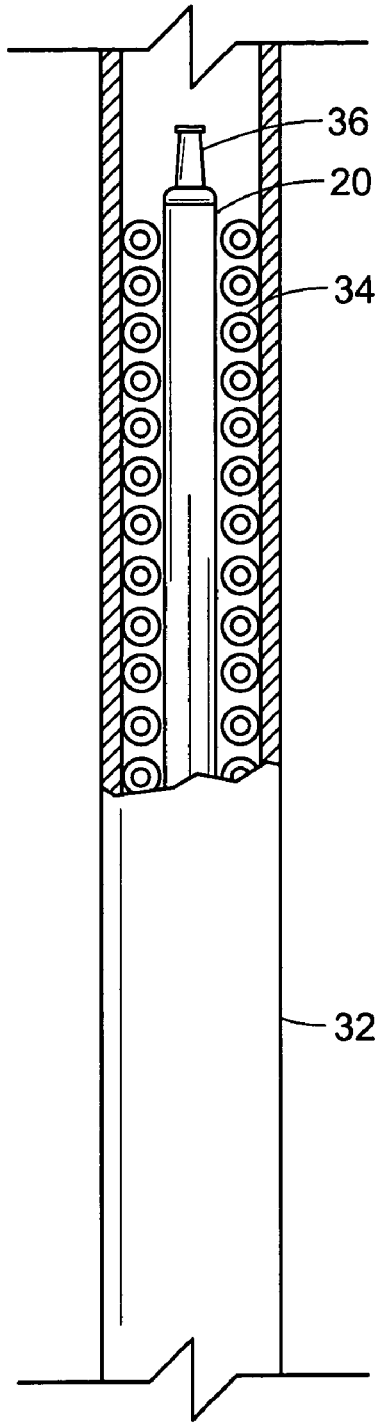
FIG. 3 is an exploded elevational view with parts broken away of the fire hose of FIG. 2 being propelled through the track by rollers.

An electronic control panel is in electrical communication with the reel 26 and with two columns of circular rollers 34 that line the inner walls of every track 32. The control panel regulates operation of the system 10 and is present inside the lobby of the building 12. An authorized operator, such as a building manager who is responsible for ensuring compliance with the fire code or a member of the local fire department, can access the panel and utilize it to activate and deactivate the system 10. When activating the system 10, the operator specifies the floor on which the hoses 20 are needed. As depicted in FIG. 3, each hose 20 then automatically unravels from its reel 26 at a constant rate and travels up its corresponding track 32. The rollers 34, which have a low coefficient of friction, propel the hose 20 up the track 32 until it arrives at the designated floor, completely unravels and becomes taut. In order to do so, the left column of rollers 34 rotates counterclockwise while the right column of rollers 34 rotates clockwise. The pump 30 turns on and transports a regulated quantity of filtered water from an independent source such as a local river through the piping network 28. The water travels in laminar flow and distributes evenly to each reel assembly 18. Thus, the flow rates of water through the hoses 20 are approximately equal.

When firefighters respond to the scene, they ascend to the appropriate floor, open the nozzle 36 on the front end of each hose 20 and spray water onto the fire. Alternatively, the firefighters can utilize a helicopter to land on the roof of the building 12 and attach their own hoses to a station 38. A pair of standpipes 42 extends from the station 38 and feeds into the piping network 28 through a substantially vertical connection pipe 40. When the operator activates the system 10, water travels from the pump 30, through the connection pipe 40, into the station 38 and, when fire hoses are connected thereto, through the standpipes 42. After the firefighters have completed their work, the operator deactivates the system 10. The pump 30 turns off and any residual water in the system 10 returns to the water source through the piping network 28. If the hoses 20 have been utilized, they descend the tracks 32 at a constant rate. Inside each track 32, the left column of rollers 34 rotates clockwise while the right column of rollers 34 rotates counterclockwise. Each hose 20 returns to its reel assembly 18 in the storage area 14 and compactly wraps around the reel 26.

In conclusion, herein is presented a fire hose storage and deployment system and method. The invention is illustrated by example in the drawing figures, and throughout the written description. It should be understood that numerous variations are possible, while adhering to the inventive concept. Such variations are contemplated as being a part of the present invention.

What is claimed is:

1. A system for storing and deploying fire hoses to combat a fire on a selected floor of a high-rise building, the building having a roof, side walls and an underground storage area directly beneath the building, the system comprising:

a plurality of reel assemblies located inside the storage area, each reel assembly having a circular reel, a fire hose with a front end and a rear end, and an underground standpipe having an inlet and an outlet, the hose compactly wrapping around the reel, the rear end of the hose being fastened to the outlet of the underground standpipe;

a plurality of mechanical tracks that each has a closed upper end and an open lower end, each track extending vertically along the side walls such that the upper end reaches the roof and the lower end projects into the storage area;

an underground pump, the pump increasing the flow rate and pressure of water obtained from an independent source; and an integrated piping network attaching to the inlet of each standpipe and distributing the water to the hoses.

2. The system as recited in claim 1, further comprising a station located on the roof that has a pair of roof standpipes extending therefrom, the roof standpipes feeding into the piping network through a substantially vertical connection pipe.

3. The system as recited in claim 2, wherein a pair of columns of circular rollers is present inside each track, and wherein each reel assembly is positioned below one of the tracks.

4. A method of quelling a fire on a floor of a high-rise building using a system having an underground storage area, a plurality of reel assemblies inside the storage area, an underground pump, an integrated piping network and a plurality of mechanical tracks, each reel assembly having a circular reel, a fire hose wrapped therearound and an underground standpipe, each track having rollers disposed therein, the method comprising the steps of:

accessing an electronic control panel;

utilizing the control panel to specify the floor on which the fire is raging;

unraveling the hoses from their reels;

propelling the hoses up the tracks by rotating the rollers;

turning on the pump;

using the pump to transport water from an independent source, through the piping network and to the hoses;

spraying the water on the fire by opening nozzles on the hoses; and deactivating the system.

5. The method of quelling a fire as recited in claim 4, wherein the step of deactivating the system further comprises the steps of:

turning off the pump;

returning any residual water in the system to the water source;

propelling the hoses down the tracks by rotating the rollers; and wrapping the hoses around their reels.

* * * * *